US006393981B1

(12) United States Patent
Cameron

(10) Patent No.: US 6,393,981 B1
(45) **Date of Patent: *May 28, 2002**

(54) MULTIPLE COLOR PRINTER HAVING VERTICALLY MOVEABLE PRINT PAD

(76) Inventor: Robert Cameron, 3245 W. Bellwood La., Glenview, IL (US) 60025

( * ) Notice: Subject to any disclaimer, the term of this patent is extended or adjusted under 35 U.S.C. 154(b) by 0 days.

This patent is subject to a terminal disclaimer.

(21) Appl. No.: 09/606,950

(22) Filed: Jun. 30, 2000

Related U.S. Application Data

(63) Continuation-in-part of application No. 09/207,804, filed on Dec. 9, 1998, now Pat. No. 6,123,021.

(51) Int. Cl.[7] ..... B41F 17/30; B41M 1/18

(52) U.S. Cl. ..... 101/163; 101/41; 101/424.1; 101/193

(58) Field of Search ..... 101/35, 41, 42, 101/43, 44, 150, 163, 167, 169, 170, 193, 424.1, 425, 488

(56) References Cited

U.S. PATENT DOCUMENTS

| | | | | | |
|---|---|---|---|---|---|
| 4,060,031 | A | * | 11/1977 | Philipp | 101/163 |
| 4,683,821 | A | * | 8/1987 | Berberich | 101/170 |
| 4,738,199 | A | * | 4/1988 | Chen | 101/163 |
| 4,811,662 | A | | 3/1989 | Sterman | 101/170 |
| 5,272,973 | A | * | 12/1993 | Chojnacki | 101/163 |
| 5,392,706 | A | * | 2/1995 | Drew, II et al. | 101/170 |
| 5,664,496 | A | | 9/1997 | Scheuhing | 101/169 |

FOREIGN PATENT DOCUMENTS

| | | | |
|---|---|---|---|
| DE | 3608125 | 9/1987 | |
| EP | 0424716 | 5/1991 | 101/163 |
| GB | 2171645 | 9/1986 | 101/163 |

* cited by examiner

*Primary Examiner*—Leslie J. Evanisko
(74) *Attorney, Agent, or Firm*—Robert L. Marsh

(57) ABSTRACT

A machine for printing a plurality of colored patterns on the surface of a contact lens has a plurality of parallel oriented print stations each of which has an image die and an ink cup for applying ink into the image in the die. A slide is moveable between the plurality of the print stations such that a contact lens on the slide can receive printing at each of the stations. The slide also carries a vertically moveable print pad for applying printing to a lens and an indexing cleaning tape for cleaning the print pad. Each of the print stations has a separate control for independently setting a dwell time for the print pad before applying ink to the contact lens.

7 Claims, 6 Drawing Sheets

MULTIPLE COLOR PRINTER HAVING VERTICALLY MOVEABLE PRINT PAD

The present application is continuation-in-part of my application filed Dec. 9, 1998 as Ser. No. 09/207,804, now U.S. Pat. No. 6,123,021. The present invention relates to a device for printing coloring on contact lenses and in particular to a device for printing a plurality of colors on each lens, and for simultaneously printing coloring on a plurality of lenses.

BACKGROUND OF THE INVENTION

Coloring can be applied to the surface of contact lenses to alter the coloring of the eyes of the person wearing the lenses. The coloring of the pupil of the human eye is, however, very complex. The center of the pupil has a deep, almost black, solid color, while the outer periphery of the pupil has a lighter, distinguishable color such as brown, hazel, blue, green, or some blend thereof, although this outer periphery of the pupil is not uniform in color. The coloring may be deeper near the outer edges of the pupil than near the dark center, and the coloring may be a composition with a background of one color and fine lines which extend radially inward from the outer circumference of the pupil with the fine lines having a deeper, perhaps different color than the background color. A combination of three or four colors, therefore, may be required to duplicate the coloring of the human eye. Coloring printed on a contact lenses which, when fitted into the eyes of a wearer, will change the coloring of the eyes of the wearer and not appear to be unnatural, must have a pattern of colors which duplicates the pattern of the human eye.

To print a pattern having a plurality of colors onto a contact lens, the pattern must be broken down into sub patterns, with each sub pattern corresponding to one of the colors which make up the coloring of the pattern. The sub patterns must be aligned such that the printing ink of one color does not overlay upon the printing of ink of another color because the multiple layering of the ink will create an uneven surface which can cause irritation in the eye of the wearer, and it will give an unnatural coloring to the pattern. Both of these consequences reduce the desirability of the contact lens to which the coloring has been applied.

Machines are currently available which apply a plurality of sub patterns of color to a contact lens which combine into a single pattern by providing a carousel having a plurality of retainers for retaining lens to which colors are to be applied. As the carousel rotates the lens retained on a retainer is moved from one coloring station to another with the pattern for a different coloring applied at each of the stations. Each of the stations includes a vertically moveable print pad and a first assembly for applying a sub pattern of fresh ink to the print pad before the print pad is pressed against a contact lens and a second assembly for removing residue ink from the print pad after the pad has been used to apply ink to a contact lens. Each first assembly has an image die having a pattern therein which is moveable, or "doctored," to a first position at which ink is applied into the pattern of the die after which it is doctored to a second position below a print pad. The print pad is lowered and compressed upon the image die and thereafter elevated, after which the ink from the image die is retained on the print pad. The image die is doctored back to the first position at which ink is reapplied. With the image die doctored out from under the print pad, the carousal can be rotated to move the lens retainer with a contact lens thereon beneath the print pad, and the print pad is again lowered to apply ink to the surface of the contact lens. After the print pad is again raised, an incremental rotation of the carousal will then move the retainer and contact with printed material thereon towards its next stage.

Residue ink on the print pad is removed by a cleaning element in the form of a section of a three inch wide cellophane tape. When the print pad is lowered to the adhesive material, the tape adheres to any remaining ink left on the print pad. When the print pad is subsequently raised the role of cellophane tape is incrementally advanced to position a clean section of tape on the table for cleaning the print pad after the next printing cycle. The cycle is then repeated with the print pad moving downwardly for a brief period of time, first to receive ink from the image die, second to apply the ink to a contact lens, and third to contact the adhesive of the tape to remove excess ink from the surface thereof.

Machines as described above will produce high quality colored lenses with patterns printed thereon which duplicate the appearance of the pupil of the human eye, although such machines do have limitations. First, there are practical limitations to the size of the carousel and therefore there are limitations to the number of lenses which can be simultaneously printed by such machines. Second, by the nature of their circular configuration, the machines have substantial space requirements. Third, the machine moves one of the three elements of image die, cleaning table, and contact lens container successively below the print pad and the speed at which the machine operates is limited by the speed at which the elements can be successively first moved under the print pad and then be removed therefrom.

Another problem arises from the inks applied to objects such as contact lenses because each ink color has different properties for application and drying. Specifically different colored inks for contact lenses have different dwell times, the dwell time being the time fresh ink must set on the print pad before the ink is applied by the pad to the print surface. If ink is applied prematurely, it may blot and if the ink is retained on the print pad too long, it may continue to adhere to the pad and not be applied to the print surface. To retain an ink of a color on a print pad for a given period of time, the print pad can be held motionless over a print surface for a time period (the dwell time) which when added to the time required for the pad to be moved from the inking step to the printing step equals the given period of time. The dwell time for a carousel type machine cannot be individually adjusted without slowing the entire machine to accommodate the longest dwell time.

Another limiting factor to existing machines is the time needed for the ink to dry on a surface before the surface can receive the application of a different color ink. Existing machines must be operated at a sufficiently slow speed to allow a first application of ink to dry before a second is applied.

It would be desirable to provide a machine for which the dwell time for each print cycle can be individually adjusted. It would also be desirable to provide a means for accelerating the drying process for the ink.

SUMMARY OF THE INVENTION

Briefly, the present invention is embodied in a machine for applying a plurality of inked patterns, each with a different color, to a surface such as a contact lens to give the surface a desired appearance such as that of the pupil of a human eye. In accordance with the invention, the machine has a plurality of print stations in side-by-side relationship and a carriage is linearly moveable from one station to another. Where four colors are to be applied to a contact lens, the carriage would move across four color stations to thereby apply four colors to the lens, and where fewer colors are required, the carriage would be adapted to move to only the number of stations necessary to provide the required coloring. Each of the stations have a moveable image die having a planar horizontal surface with a pattern of indentations are for receiving a coloring material such as an ink. The image die is horizontally moveable for doctoring between a first position at which color is applied into the pattern of the die and a second position in which it can be contacted by a print pad for transferring the ink thereto.

Mounted on the carriage is a retainer for retaining the contact lens and a cleaning table across which segments of tape are incrementally advanced. Also mounted on the carriage is a gantry for retaining a horizontally and vertically moveable print pad, the horizontal movement being in a second direction perpendicular to the first direction of movement of the carriage. When the carriage is positioned at a given print station, movement of the print pad in the second direction will successively move the print pad over the image die of the given print station, the retainer on which the contact lens is retained, and the cleaning table across which the tape is advanced.

The movement of the carriage and the print pad are controlled by an appropriate motor, such as pneumatic cylinders. A first motor is provided to move the carriage from a first print station to a second print station, a second motor is provided to move the image die from its first position to a second position. A third motor moves the print pad to any one of three locations, the first location in which the print pad is over the cleaning table, the second location in which the print pad is over the image die, and the third location where the print pad is over the retainer for the contact lens. A fourth motor moves the print pad from an elevated position to a downward position to thereby apply the print pad successively against the image die, the print surface on the retainer, and the cleaning tape on the table.

Since the print pad is moveable on the carriage, the pad is repositioned for printing a new ink color by a single movement of the carriage to the next print station. Also, since all the steps of the printing process are linearly aligned in the second direction, a simple movement of the print pad along the gantry repositions the print pad to carry out each of the successive steps. Existing machines, on the other hand require two or more steps between successive operations of the print pad. One step to remove the completed operation from under the print pad, and a second step to move the next operation under the print pad. The speed at which existing machines can operate is limited by the multiplicity of steps required between successive operations of the print pad.

In accordance with one feature of the invention, a timer is provided at each print station to control the dwell time of the print pad following the inking of the print pad at the second location and prior to the application of the ink to the print surface.

Another feature of the invention is a blower to expedite the drying of the ink. According to this feature, air from a compressor is passed through a filter to remove small particles suspended therein, after which the stream of air from the compressor is directed to the print surface to facilitate the drying of ink applied thereto.

BRIEF DESCRIPTION OF THE DRAWINGS

A better understanding of the present invention will be had after a reading of the following descriptions taken in conjunction with the drawings wherein.

DETAILED DESCRIPTION OF A PREFERRED EMBODIMENT

Figure 1:
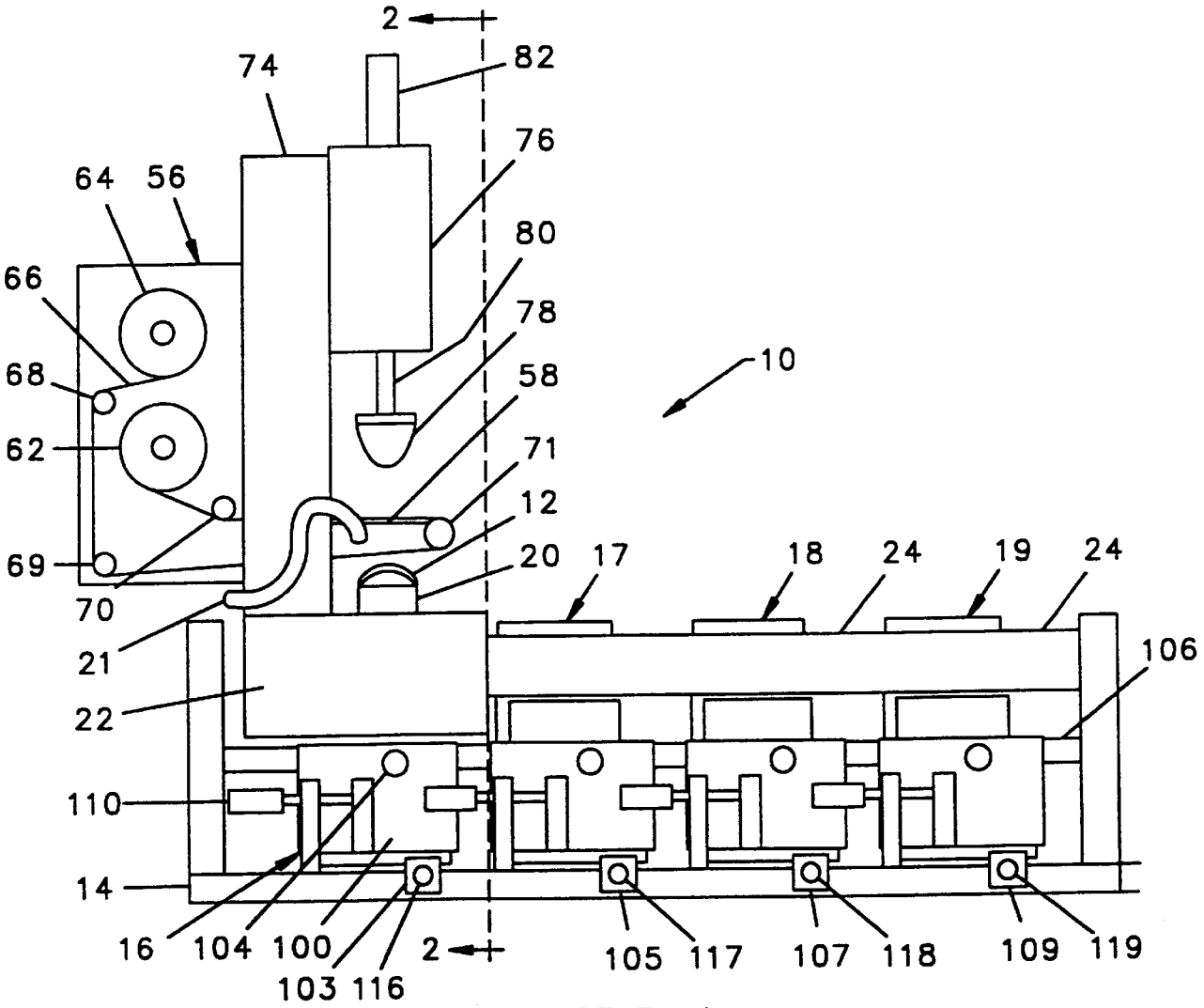
FIG. 1 is a top elevational view of a machine in accordance with the present invention.
Figure 2:
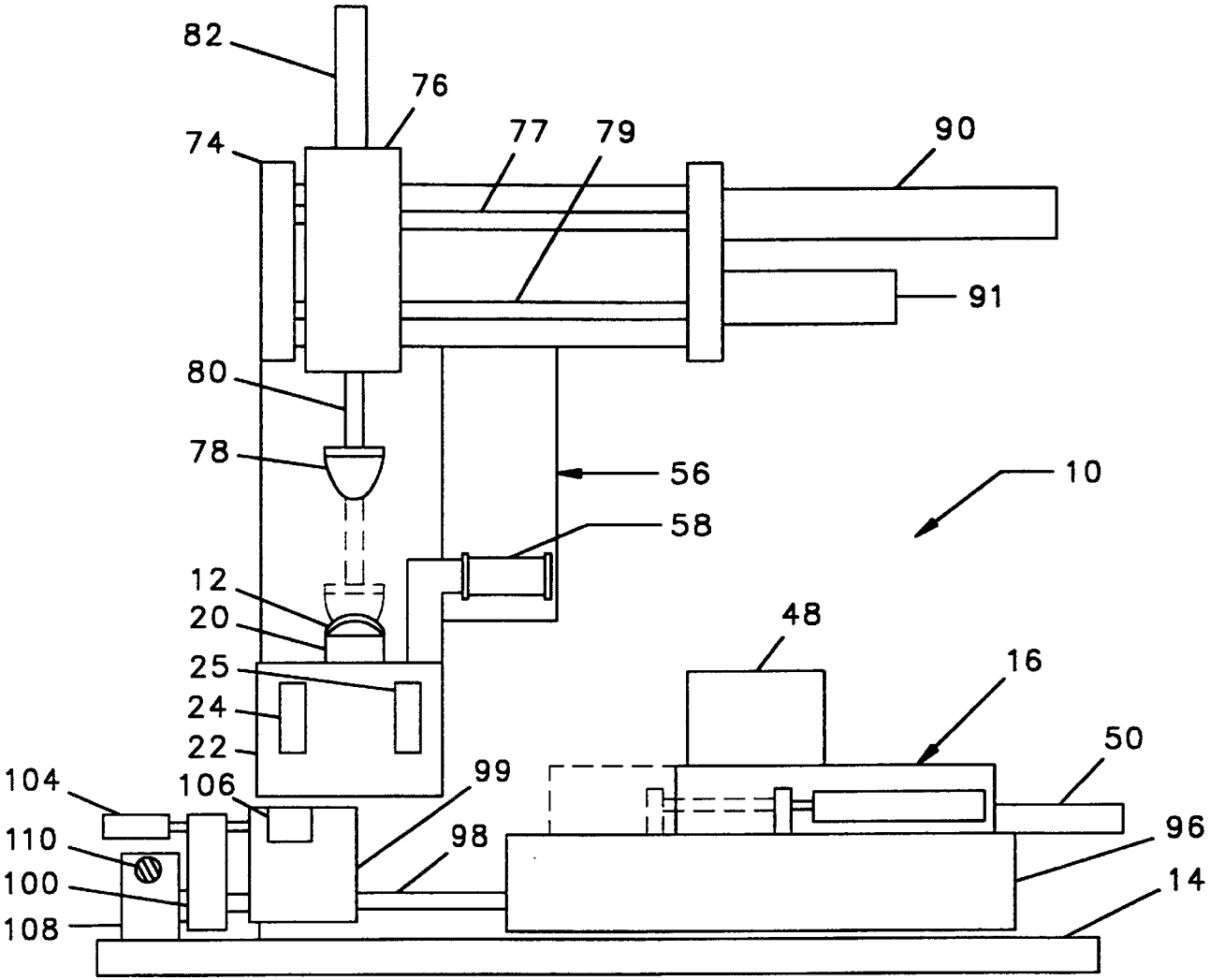
FIG. 2 is a cross section view of the machine shown in FIG. 1 taken through line 2—2 thereof.

Referring to FIGS. 1 and 2 a printing machine 10 for printing the design of a pupil of an eye on a contact lens 12 has a base 14 on which are mounted a plurality of print stations 16, 17, 18, 19. There are four print stations 16, 17, 18, 19 in the embodiment depicted, however the machine can be made with any number of print stations of which station 16 is representative of all such stations. For the purposes of this description the elements common to all the stations will be described with respect to station 16.

To apply a plurality of colors to the lens 12, the lens is mounted on a lens retainer 20 of the type known in the art, and the retainer 20 is fixedly mounted on a linearly moveable carriage 22 for movement along a rail 24 such that the carriage 22 and retainer 20 can be positioned for the lens 12 to receive printing from any of the print stations 16, 17, 18, 19. The machine 10 as depicted, therefore, can print a multi-colored pattern on the lens 12 having at least four colors, one for each of the print stations 16, 17, 18, 19. The machine 10 can, of course, be configured to apply any number of colors by increasing or decreasing the number of stations in the bank of stations needed to print color on a lens. Also, the machine can be configured into a plurality of banks with each bank having the required number of print stations to apply all the colors needed on a print surface.

As shown in FIG. 2, positioned near the retainer 20 is a nozzle of a blower line 21 through which pressurized air is directed at the print surface 12 to expedite the drying of ink printed thereon.

Figure 6:
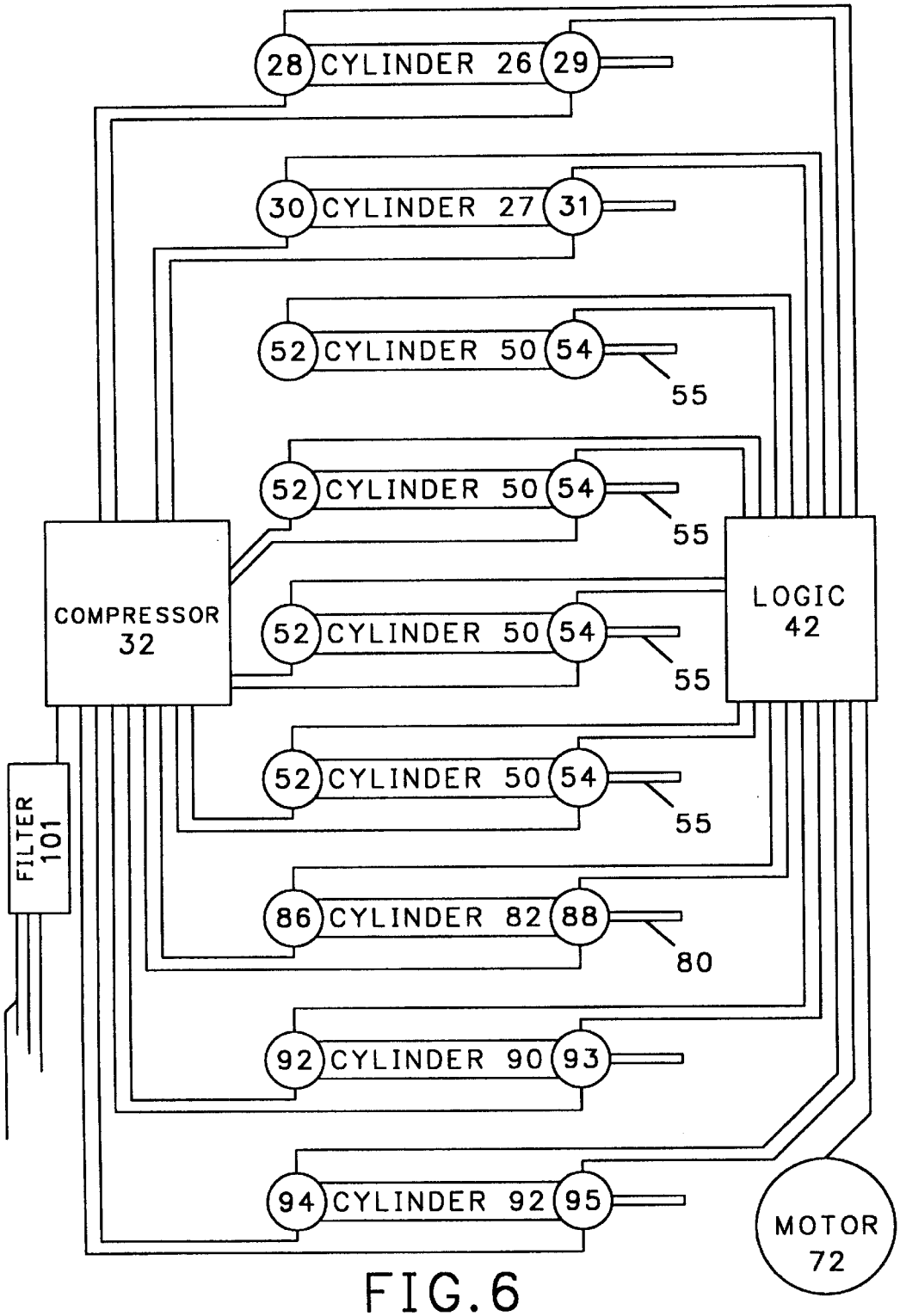
FIG. 6 is a block diagram of the electronic and pneumatic circuits for the machine shown in FIG. 1.

Referring to FIGS. 1 and 6, movement of the carriage 22 along the rails 24, 25 is controlled by an appropriate motor such as a plurality of pneumatic cylinders, of which two 26, 27 are shown only in FIG. 6. The carriage 22 is depicted in FIG. 1 as being positioned to print an image on the contact lens 12 at print station 16, but can be moved to any of the other stations 17, 18, 19 by valves 28, 29, 30, 31 to direct compressed air from a source 32, such as compressor 32. The sequencing of the opening and closing of the various valves is controlled by a logic means known in the art, such as a microprocessor 42.

Figure 3:
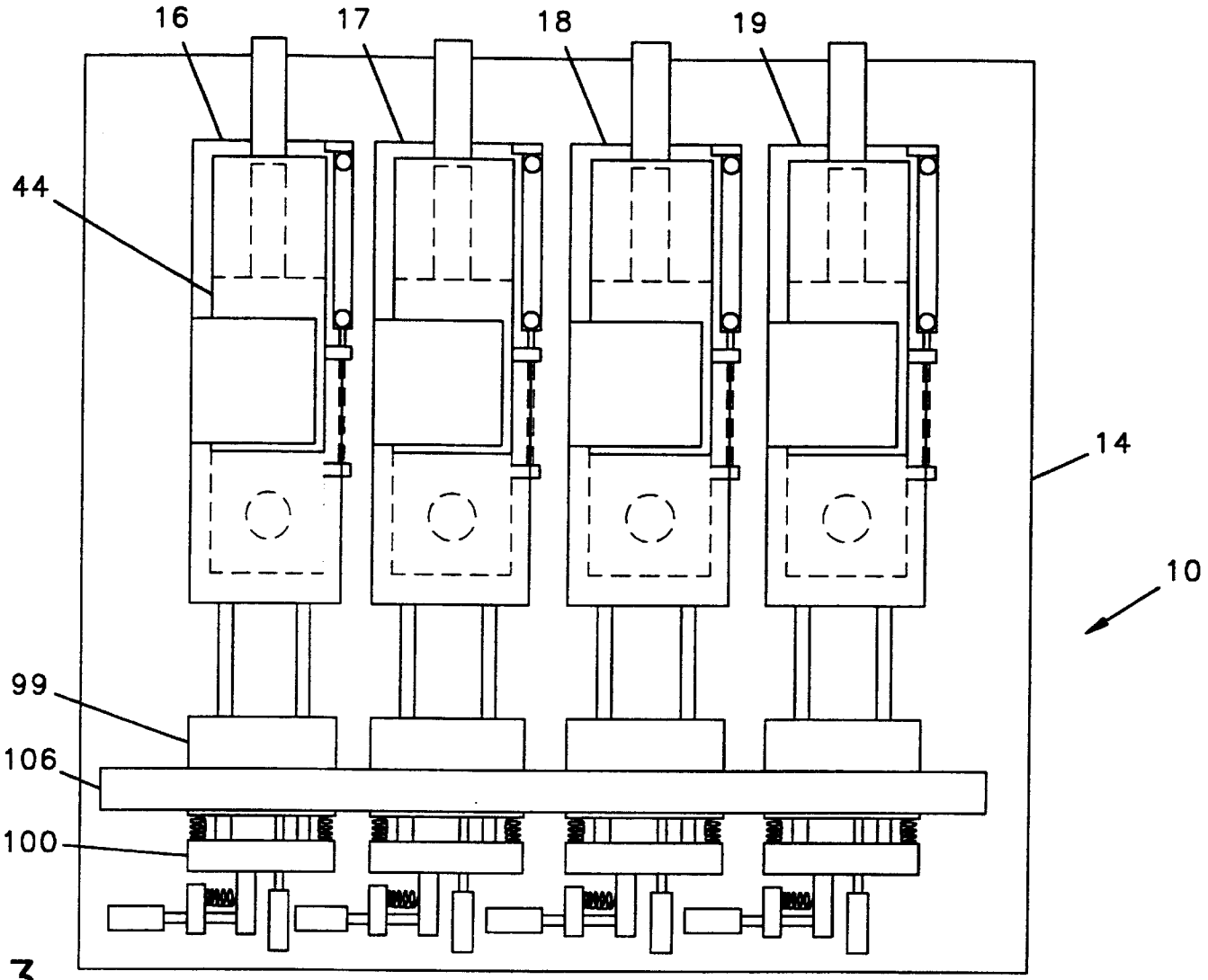
FIG. 3 is a top view of the machine shown in FIG. 1 with the gantry, the carriage and the carriage tracks removed exposing the image dies and the moveable platforms on which the image dies are mounted.
Figure 5:
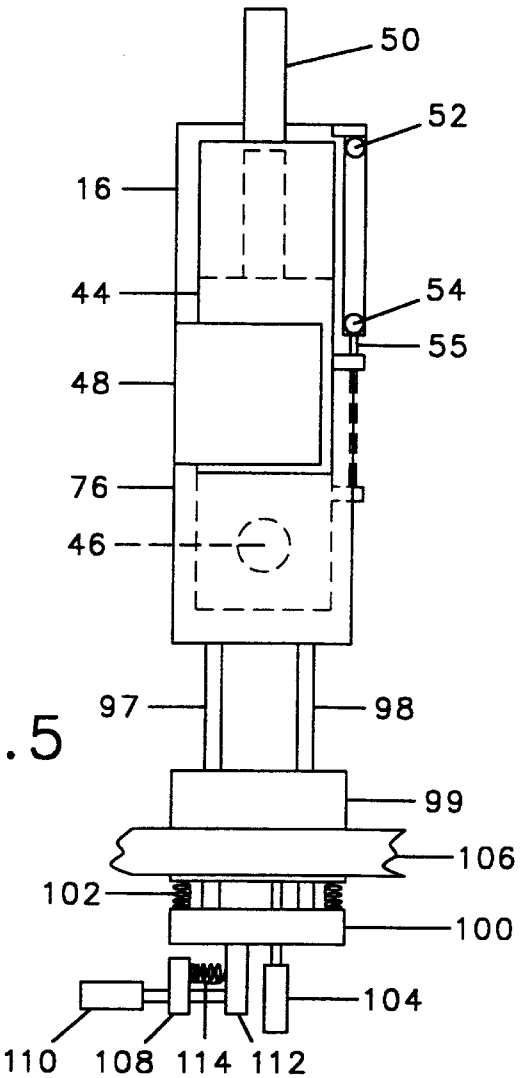
FIG. 5 is a fragmentary enlarged top elevational view similar to that shown in FIG. 3 but showing a single image die and the micrometers for the positioning thereof.

Referring to FIGS. 2, 3, and 5, print station 16 includes a moveable planar image die 44 having an image 46 etched in the upper surface thereof. The image die 44 is slideably moveable to a first position shown in solid lines in FIGS. 3 and 5 wherein the image 46 is positioned below an ink cup 48. Once ink has been applied into the etchings of the image 46, the image die is moved, or "doctored," to a second position shown in broken lines on FIGS. 3 and 5 wherein the image 46 is exposed.

Referring to FIGS. 5 and 6, movement of the image die 44 from the first position under the ink cup 48 to the second position shown in broken lines is caused by a pneumatic cylinder 50 into which compressed air is admitted through the appropriate valves 52, 54 thereof for either extending or retracting the associated shaft 55 to which the image die 44 is attached. Control of the valves 52, 54 is carried out by the microprocessor 42, which receives input from sensors, not shown. The sensors, not shown, are positioned at the ends of each of the various cylinders, and the microprocessor 42 is programmed to control the opening and closing of all the valves described herein to cause the cylinders to successively carry out the functions as described.

In addition to the lens retainer 20, the carriage 22 has mounted thereon a cleaning assembly 56 having a horizontal table 58 across which a role of cleaning material, in the form of a cellophane tape is incrementally advanced after each printing on the lens 12. As shown in FIGS. 1 and 6, the cleaning assembly 56 includes a supply spool 64 and a take-up spool 62 with a length of tape 66 threaded across a plurality of idlers 68, 69, 70, 71 as it moves from the supply spool 62 across the upper surface of the table 58 to the take-up spool 64. An electric motor 72 which is also controlled by the micro processor 42, rotates the take-up spool 64 after each printing on the lens 12 thereby incrementally advancing the tape 66 across the upper surface of the table 58 to expose a clean portion of tape 66. The adhesive surface of the tape 66 is extended upwardly so that it will retain residual ink from the print pad during a cleaning step following each print on a contact lens.

Referring to FIGS. 1, 2, and 6, the carriage 22 further includes a gantry 74 having a slide 76 moveable along a pair of slide bars 77, 79 in a direction perpendicular to the movement of the carriage 22. Mounted on the slide 76 is a vertically moveable print pad 78 having a shaft 80 which is slideable within a cylinder 82 such that the print pad 78 is moveable from an elevated position, shown in solid lines on FIG. 2, to a lowered position shown in broken lines. The vertical movement of the shaft 80 in the cylinder 82 is controlled by the associated valves 86, 88 which are also operated by the microprocessor 42.

Referring to FIGS. 2 and 6, the slide 76 is moved along the slide bars 77, 79 on the gantry 74 by a pair of cylinders 90, 91 having associated valves 92, 93, 94, 95 all of which are controlled by the microprocessor 42. The cylinders 90, 91 and the associated valves are configured to stop the slide at the three fixed locations. In the first location the slide is at the right hand end of the slide bars 77, 79, as viewed in FIG. 2 and the print pad 78 is positioned above the image die. When the slide 76 is in this location and the shaft 80 is momentarily extended to lower the print pad 78 to contact the upper surface of the image die 44, the ink of the image 46 will be transferred to the surface of the print pad. The slide 76 is then moved to a second location at the far left end of the slide bars 77, 79 as shown in FIG. 2, in which the print pad 78 is above the lens retainer 20. When the shaft 80 is again momentarily extended, the print pad 78 will contact the upper surface of the contact lens 12 and the ink on the lower surface of the print pad will then be applied to the upper surface of the contact lens. The slide 76 is then moved by the cylinders 90, 91 to the third location midway between the first and second locations so that the print pad 78 over the cleaning table 58. The shaft 80 is again extended lowering the print pad 78 to contact the adhesive material on the tape 66 to thereby remove excess ink left on the surface of the print pad.

Referring to FIG. 6, after the print pad 78 has contacted the surface of the tape 66, the micro processor 42 will direct the motor 72 to rotate the take-up spool 64 and the tape 66 will incrementally advance a clean portion of tape across the tape 58. Similarly, after the print pad 78 has momentarily contacted the upper surface of the image die 44, the microprocessor 42 will operate the valves 52, 54 to move the image die 44 under the ink cup 48 where ink will again be applied into the etching of the image 46. After ink has been applied into the etching 46 the microprocessor 42 will operate the valves 52, 54 to move the image die 44 to the second position where the upper surface thereof can again be contacted by the print pad 78 to repeat the print cycle.

Figure 7:
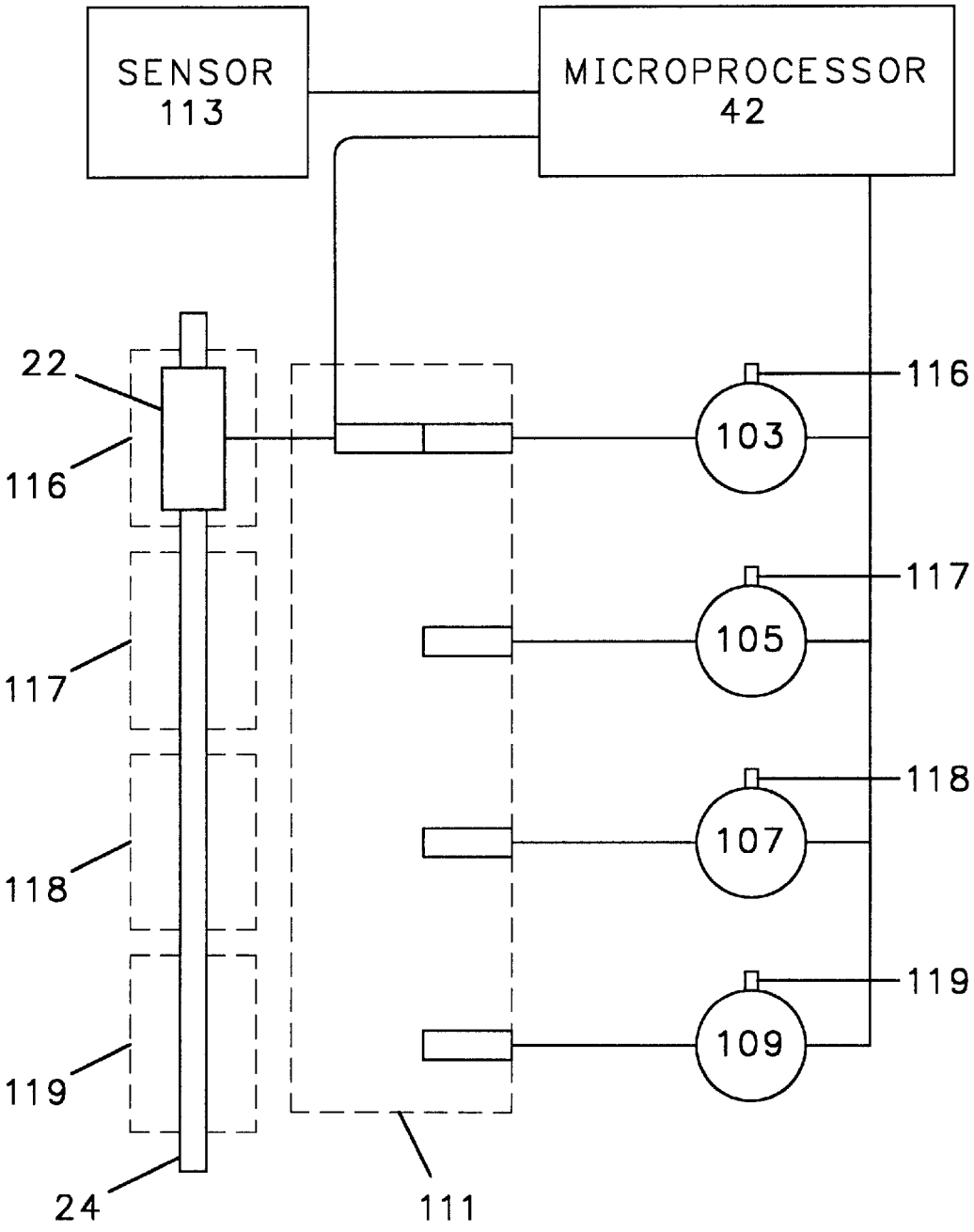
FIG. 7 is a schematic diagram of the portion of the circuit for the machine shown in FIG. 1 which regulates the dwell time of the print pad.

Referring to FIGS. 1 and 7, the circuit for the machine 10 includes dwell timing devices 103, 105, 107, 109 for each of the stations 16, 17, 18, 19 respectively and a selection switch 111 operated by the movement of the carriage along the rail 24. The selector switch 111 is closed for the circuit of the timing devices 103, 105, 107, 109 associated with the print station 16, 17, 18, 19 at which the carriage 22 is located. The selected timing device 103, 105, 107,109 is activated by a sensor 113 which detects that the print pad 78 is in the elevated position and located over the retainer 20. Each of the timing devises 103, 105, 107, 109 has a control knob 116, 117, 118, 119 respectively, for selecting the time the associated timing device 103, 105, 107, 109 will allow to elapse. During this period the print pad will remain in the elevated position over the print surface. After the expiration of the selected period of time the timing device will send signal to the valves 86, 88 operating the valve to extend the shaft 80. The shaft will then extend, causing the print on the print pad to be applied to the print surface 12. The control knobs 116, 117, 118, 119, the timing devices 103, 105, 107, 109, the switch 111, and the sensor 113, therefore, permit the operator to individually select the desired dwell time for each of the print stations 16,17,18, 19.

After the lens 12 has received printing from the first print station 16, the microprocessor 42 will operate the valves 28, 29, 30, 31 for the cylinders 26, 27 to reposition the carriage 22 with the gantry 74 thereon before another of the print stations 17, 18, 19. The print cycle is thereafter repeated at the new print station where a print pattern of a second color is applied to the lens 12. It should be appreciated that since the print stations are linearly oriented, the machine 10 can be constructed to accommodate any number of print stations 16, 17, 18, 19 by merely extending the length of the machine. A machine accommodating any number of print stations can thereby be positioned on a shop floor and all the stations will be readily accessible by technicians for placing a new lens 12 on the associated retainer 20. There is, therefore, no practical limitation to the size of the machine 10.

As shown in FIGS. 1 and 6, a plurality of blower lines 21, one blower line 21 for each carriage 22 and retainer 20, are connected to the output of the compressor 32 and the blower lines 21 have a filter 101 along their length for filtering particles suspended in the air passing therethrough. The distal end of each of the blower lines 21 has a nozzle directed to discharge a stream of air at the print surface of the object in the retainer 20 to facilitate the drying of the ink applied thereto as described above.

Figure 4:
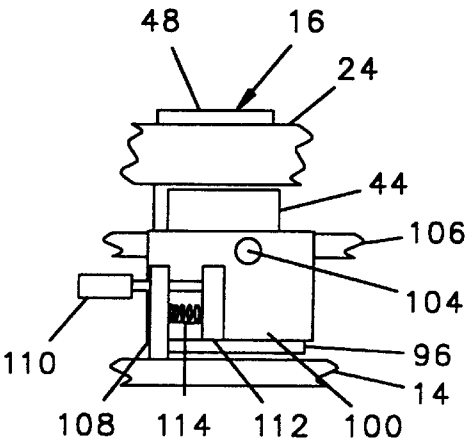
FIG. 4 is a fragmentary enlarged front elevational view of the machine shown in FIG. 1 showing micrometers for positioning the image dies thereof.

Referring to FIGS. 4 and 5, to precisely position the application of ink to the lens 12 the image 46 in the die 44 must be precisely positioned with respect to the print pad 78. The die 44 is therefore mounted on a moveable platform 96. A pair of rods 97, 98 extend from the platform 96 through parallel holes in a block 99 to a face plate 100 permit the platform 96 to move in a first direction. A spring 102 urges the face plate 100 towards the block 99 and first micrometer 104 having a threaded shaft extending through the face plate

100 to the block 99 allows accurate adjustment of the image 46 in the die 44 in the first direction. The block 99 is also slideable along a slide bar 106 to permit movement of the platform 96 and the image die 44 in a second direction perpendicular to the first direction. A plate 108 mounted on the base 14 has a threaded hole therein parallel to the axis of the slide bar 106 through which a second micrometer 110 is threaded. The distal end of the micrometer 110 contacts the surface of a contact plate 112 mounted on the face plate 100, and the plate 112 is urged toward the plate 108 by a spring 114. Adjustment of the second micrometer 110 will adjust the position of the image die 44 and the image 46 therein in the second direction.

While a single embodiment of the present invention has been depicted, it will be appreciated by those familiar with the art that many modifications and variations may be made without departing from the true spirit and scope of the invention. It is, therefore, the intent of the appended claims to cover all the modifications and variations which fall within the true spirit and scope of the invention.

What is claimed:

1. A device for applying a plurality of coloring materials to a product having a print surface comprising a plurality of print stations, each of said print stations having an image die, each of said image dies having a surface with a pattern of indentations therein for receiving one of said plurality of coloring materials, a vertically moveable print pad for applying said coloring materials to said print surface, moving means for moving one of said print pad and said plurality of print stations with respect to the other whereby said print pad successively encounters each of said plurality of print stations as a result of said movement, each of said print stations having an adjustable timing means for selecting a dwell time wherein said dwell time is a portion of a set up time during which said print pad remains in an elevated position before being lowered to apply said coloring materials to said print surface, and selector means connected to said moving means for selecting said dwell time associated with one of said print stations whereby one of said coloring materials will set on said print pad for a predetermined period of time before being applied to said print surface.

2. The device for in accordance with claim 1 and further comprising a retainer for retaining the product on which said print surface is located, means for directing a stream of air towards said retainer for drying said coloring materials applied to said product by said print pad.

3. A device for applying a plurality of coloring materials to at least one product having a print surface comprising a plurality of print stations in side by side relationship to form at least one bank of print stations, each of said print stations of said at least one bank having an image die for receiving one of said plurality of coloring materials, a carriage horizontally moveable to each of said print stations of said at least one bank, a print pad mounted on said carriage, retaining means for retaining the product, said retaining means mounted on said carriage, means for successively applying said one color material in said image die of each of said print stations to said print surface of said at least one product in said retaining means, said means for successively applying comprises means for contacting said print pad to said image die of each of said print stations for successively applying said coloring materials in said image dies of said plurality of print stations to said print pad and means for contacting said print pad to said print surface of said at least one product after each application of coloring material to said print pad whereby said plurality of coloring materials are successively applied to said print surface.

4. The device in accordance with claim 3 wherein said at least one product comprises a plurality of products and said at least one bank comprises a plurality of banks of said print stations, said plurality of banks of print stations arranged in side by side relationship for applying the plurality of coloring materials to the plurality of products simultaneously.

5. A device for applying a plurality of liquid coloring materials to a product where each color of said plurality of liquid coloring materials is different from every other color thereof, and each of said colors of said liquid coloring material has a dwell time which may be different from the dwell times of all other of said plurality of liquid coloring materials, said device comprising a plurality of print stations, each of said plurality of print stations having means for applying one of said plurality of liquid coloring materials to a surface, said means for applying one of said plurality of liquid coloring materials including a vertically moveable print pad wherein said print pad has a dwell time, means for moving said product to each of said plurality of print stations for receiving all of said plurality of colors, and means for setting said dwell time for each of said print stations independent of said dwell times of any other station.

6. The device of claim 5 wherein said means for setting said dwell time for each of said print stations comprises an adjustable means positioned near each of said print stations.

7. A device for applying a plurality of coloring materials to a product having a print surface comprising a plurality of print stations wherein each of said print stations is for applying one of the plurality of coloring materials to the print surface, each of said print stations having an image die, each of said image dies having a surface with a pattern of indentations therein for receiving one of the plurality of coloring materials, means for moving the product having the print surface to each of said plurality of print stations, means for applying the one of the plurality of coloring materials in each of said image dies on to the print surface of the product, said means for applying each of said coloring materials including a vertically moveable print pad having an elevated position, each of said print stations having an adjustable timing means for selecting a dwell time wherein said print pad remains in said elevated position a predetermined dwell time before applying said coloring materials to the print surface.

* * * * *